US005502854A

United States Patent [19]

Daouk

[11] Patent Number: 5,502,854

[45] Date of Patent: Apr. 2, 1996

[54] FLOATING FOLDABLE STRETCHER DESIGNED, IN PARTICULAR, FOR THE RECOVERY OF INJURED PERSONS AT SEA

[76] Inventor: Antar Daouk, 27, avenue du Maréchal Lyautey, 75016 Paris, France

[21] Appl. No.: 261,953

[22] Filed: Jun. 17, 1994

[30] Foreign Application Priority Data

Jun. 21, 1993 [FR] France ..... 93 07484

[51] Int. Cl.[6] ..... A61G 1/013; A61G 1/00

[52] U.S. Cl. ..... 5/627; 441/83; 441/129

[58] Field of Search ..... 5/625, 627, 628; 441/83, 129

[56] References Cited

U.S. PATENT DOCUMENTS

| | | | |
|---|---|---|---|
| 713,405 | 11/1902 | Crawford | 5/627 |
| 1,829,137 | 10/1931 | Harris | 441/129 |
| 3,135,972 | 6/1964 | Jakes et al. | 5/627 |
| 3,886,606 | 6/1975 | Bradford | 5/627 |
| 4,060,079 | 11/1977 | Reinhold | 5/627 |
| 4,347,635 | 9/1982 | Eisenhauer | 441/40 |

FOREIGN PATENT DOCUMENTS

| | | | |
|---|---|---|---|
| 1118819 | 2/1982 | Canada . | |
| 2565818 | 12/1985 | France | 5/625 |
| 2666297 | 3/1992 | France | 441/129 |
| 182831 | 5/1936 | Switzerland . | |
| 103773 | 2/1917 | United Kingdom . | |
| 1430597 | 3/1976 | United Kingdom . | |
| 2041764 | 9/1980 | United Kingdom . | |

*Primary Examiner*—Alexander Grosz

*Attorney, Agent, or Firm*—Finnegan, Henderson, Farabow, Garrett & Dunner

[57] ABSTRACT

Floating stretcher designed, in particular, for the recovery of injured persons at sea, of the type including a metallic framework (1) capable of being winched by a helicopter, supporting a panel (2) of composite material ensuring the buoyancy of the whole, characterized in that the panel (2) and the framework (1) are hinged (27, 6) in their median portion, so that the whole can be folded back on itself lengthwise.

11 Claims, 2 Drawing Sheets

FLOATING FOLDABLE STRETCHER DESIGNED, IN PARTICULAR, FOR THE RECOVERY OF INJURED PERSONS AT SEA

The present invention relates to an floating stretcher designed, in particular, for the recovery of injured persons at sea, of the type including a metallic framework capable of being winched by a helicopter supporting a panel made of composite material ensuring the buoyancy of the whole.

Such floating stretchers are, in particular, used by the army or the civil defence service to recover injured pilots who have fallen into the sea by means of helicopters. There exist several stretchers of this type at the present time, but none of them really gives complete satisfaction by reason, in particular, of their relatively large overall dimensions, which pose storage and transport problems.

The main object of the present invention is thus to remedy this drawback and, to do so, it proposes an floating stretcher of the aforementioned type that is essentially characterized in that the plate and the framework are hinged in their median portion, in order that the whole can folded back onto itself lengthwise.

Thus, the stretcher is of reduced overall dimensions, which facilitates both its storage and its transport by helicopter or on a man's back.

In one particular form of embodiment of the invention, the metallic framework is essentially constituted by a rigid main tube, bent in the region of the injured person's head, and the two limbs of which extend substantially parallel as far as the area of the feet, each of the limbs of this tube being provided, in its median portion, with a hinge and with a means for locking this hinge enabling the framework can be rendered rigid in unfolded position.

Preferably, the hinge is formed by a link mounted pivotally on each limb portion by means of a pin, while the locking means is formed by a female ring mounted slidably on one of the limb portions and screwing onto a male ring, provided on the other limb portion, clasping the link.

As to the panel of composite material, this is made in two rigid portions connected to one another by two hinges disposed on the sides, a means for locking these hinges being provided for rendering the said panel rigid in unfolded position.

Preferably, the hinge is constituted by a link mounted pivotally on each of the plate portions by means of a pin, while the locking means is constituted by a U-channel mounted slidably and engaging on the contiguous edges of the two panel portions on either side of the hinge.

Thanks to these different arrangements, the floating stretcher according to the invention can easily be folded or unfolded, as required, while offering very good rigidity in the unfolded position ready for use.

Advantageously, the panel of composite material mates with the shape of the main tube of the framework and comprises a perfectly plane upper face, while its lower face is provided with a bulging portion in the area of the head which extends towards the feet in two parallel longitudinal chevrons.

This special shape of the composite material panel enables the stretcher thrown into the water fully equipped to turn right side up automatically and then to float in a position that is inclined at an angle of approximately 45°, which considerably facilitates recovery of the injured person, as the latter floats in approximately the same position by reason of his life jacket.

In addition, the composite material panel is removably fixed on the metallic framework by means of a recess provided on the front portion, engaging on the bent portion of the main tube, and of two pins supported by the framework and engaging in lateral holes provided for this purpose in the panel in the region of the feet.

It is thus possible, once the injured party has been recovered and taken back to shore, to unlock the panel from the framework and to keep the injured person on the panel in order to take him directly to an X-ray service, while the framework can be equipped with a new panel for another rescue operation. For this purpose, the panel is advantageously designed so as to be transparent to X-rays.

Preferably also, the lower portion of the metallic framework is provided with a secondary tube, of smaller diameter, connected to the main tube by junction tubes and extending parallel thereto along its two limbs so as to form two sled runners, this secondary tube being interrupted in the area of each of the hinges of the main tube.

These sled runners obviously make it easier to introduce the stretcher bearing the injured person into the rescue helicopter, without thereby impairing its foldability.

Other characteristics and advantages of the invention will emerge from the description that follows of a non-limitative example of a form of embodiment, given with reference to the annexed drawings, wherein.

Figure 1:
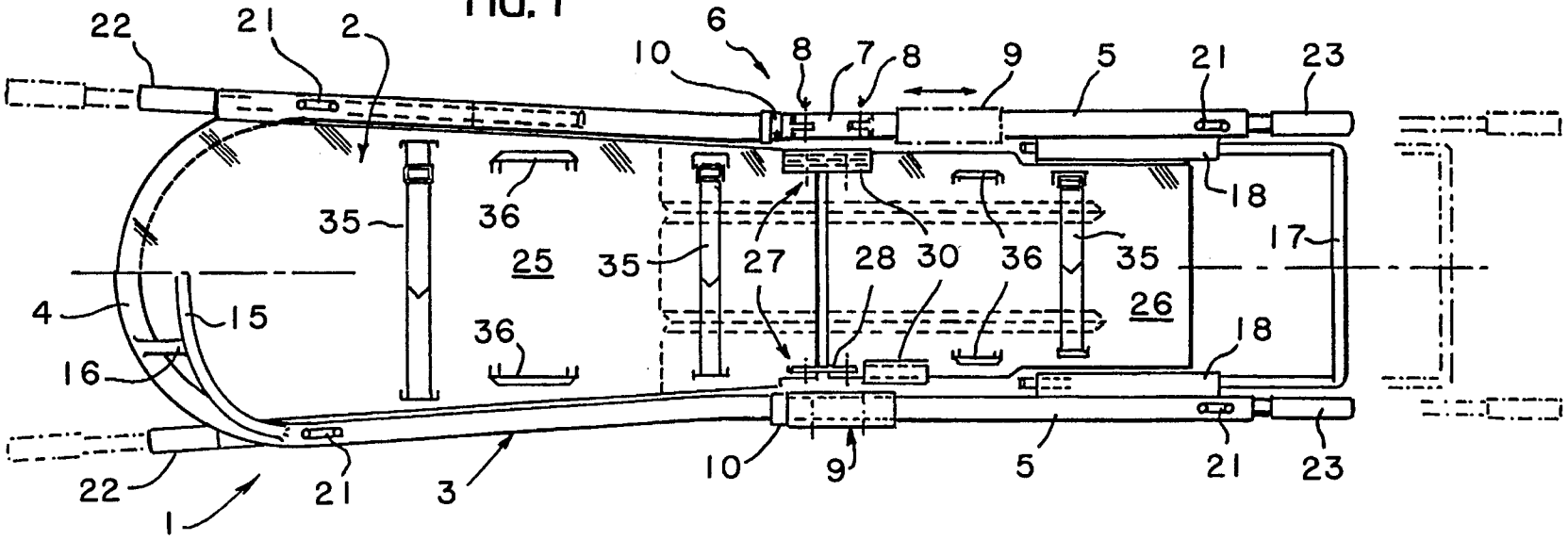
FIG. 1 is a top view of a floating stretcher according to the invention.
Figure 2:
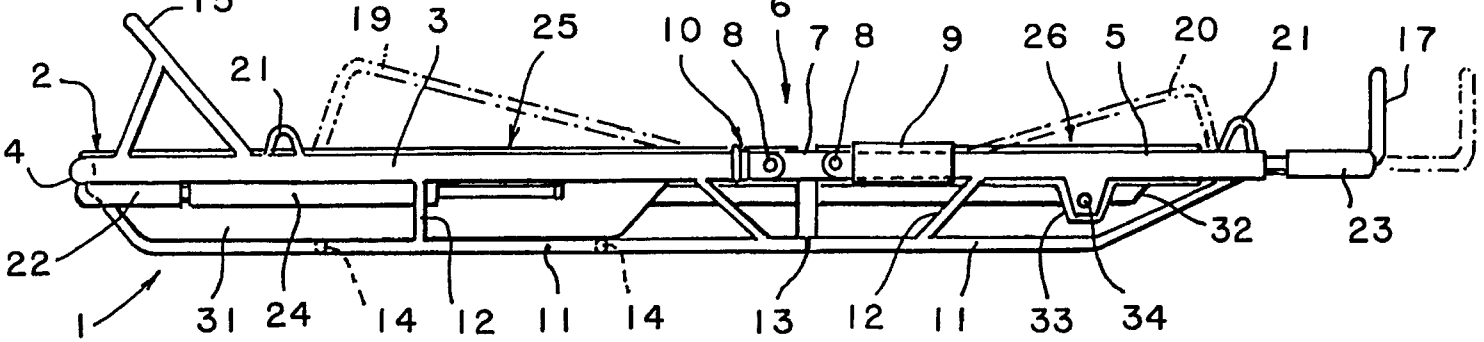
FIG. 2 is a side view of the said stretcher.

The stretcher shown in FIGS. 1 and 2 is primarily composed of a metallic framework 1 supporting a panel of composite material 2 which ensures the buoyancy of the whole. This stretcher is, in fact, designed to receive shipwrecked persons or injured persons who have fallen into the sea, in particular aircraft pilots. It goes without saying, however, that such a stretcher can also be used in any aquatic environment, lake or river, both by the army and by the civil defence service.

The metallic framework 1 is essentially constituted by a rigid main tube 3 of stainless steel, bent in the area of the portion surrounding the injured person's head, as shown at 4, and the two limbs 5 of which extend, substantially parallel, to the area of the feet, over a length of approximately 2 meters.

Figure 3:
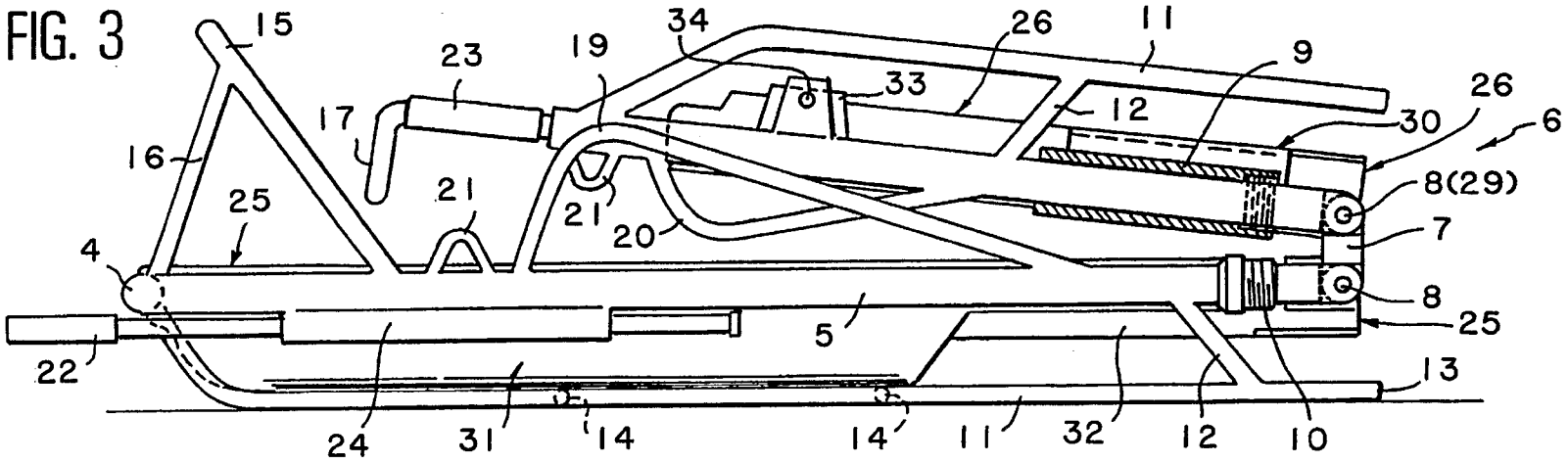
FIG. 3 is a side view of the stretcher when folded.
Figure 4:
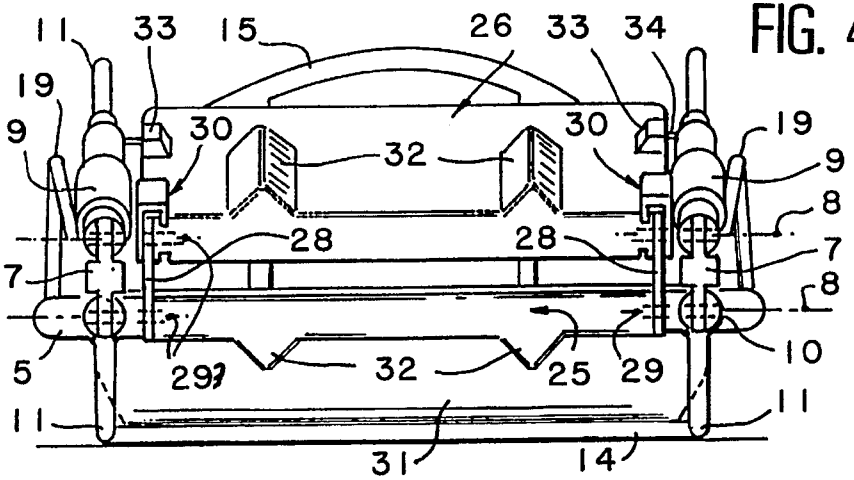
FIG. 4 is an end view of the stretcher when folded.

According to the invention, each of the limbs 5 of the main tube 3 is provided, in its median portion, with a hinge 6 enabling the stretcher to be folded back on itself, as shown in FIGS. 3 and 4. This hinge 6 is constituted here by a link 7 pivotally mounted on each limb portion by means of a pin 8. A blocking means, constituted by a female ring 9 slidably mounted on one of the limb portions 5 and screwing onto a male ring 10 fixed on the other limb portion, by clasping link 7 enables framework 1 to be rendered rigid in its unfolded position ready for use.

Metallic framework 1 is also provided, on its lower portion, with two secondary tubes 11 of smaller diameter, connected to main tube 3 by junction tubes 12 and which extend parallel thereto along the two limbs 5. The ends of these two tubes 11 are raised and welded to the main tube 3, thus forming two sled runners. Tubes 11 are, of course, cut in the area of the link type hinges 6, as shown at 13, so as not to impede the folding of the framework, but they do, nonetheless, form continuous runners facilitating the introduction of the stretcher inside the rescue helicopter, by enabling the winch operator to slide the stretcher over the edge of the cargo port.

The tubes 11 of the sled runners are further connected to one another by transverse tubes such as 14, which give framework 1 its lateral rigidity. This framework thus has a certain depth to permit reception of the panel of composite material 2 designed to support the injured person.

Metallic framework 1 also includes, on the head side, a hoop 15 welded to main tube 3 and connected to the bent portion 4 thereof by junction tubes 16. This hoop is intended to protect the head or the helmet of the wounded person when he is transported on the stretcher.

At the other end of the framework is an extensible foot-rest 17, mounted slidably in sheaths 18 welded onto the inner edges of the two limbs 5 of main tube 3. A locking means, not shown, constituted, for example, by quarter-turn pins, is further provided to block the said foot-rest, either in its retracted position or in its extended position.

Small tubes 19 and 20 are also welded to the two limbs 5 of main tube 3 so as to project upwards, thus providing lateral protection in the area of the shoulders and the shinbones for the injured person transported.

At the four ends of the stretcher and to main tube 3 are welded rings 21 to enable slings to be attached. These rings 21 are disposed in such a way that, when the stretcher is winched in by helicopter, the pendant used to make fast the stretcher automatically causes the latter to adopt a position substantially inclined at an angle of 45°. The injured party secured on the panel of composite material 2 thus remains in a relative stable position.

Finally, metallic framework 1 is also equipped, at the front, with a pair of extensible handles 22 and, at the rear, with a pair of extensible handles 23, enabling the stretcher to be transported, if necessary, by hand. The front handles 22 are mounted slidably in sheaths 24 welded to the lower edge of main tube 3, while the rear handles 23 are mounted slidably directly in the ends of the two limbs 5 of this same main tube.

Figure 5:
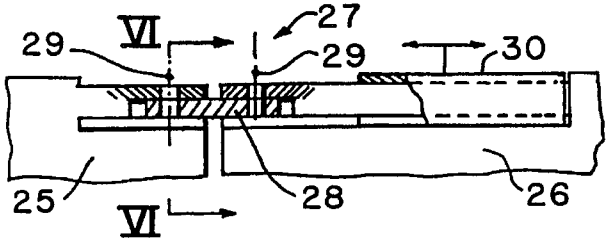
FIG. 5 is a detail view of the hinge of the panel of composite material with which the stretcher is equipped.
Figure 6:
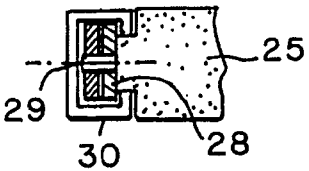
FIG. 6 is a cross sectional detail along line VI—VI of FIG. 5.

As to panel 2 of composite material, it is formed in two rigid portions 25 and 26, connected to one another by hinges 27 disposed on the sides. These hinges are constituted, here, as can be seen more clearly in FIGS. 5 and 6, by a link 28 pivotally mounted on each of portions 25 and 26 of panel 2 by means of a pin 29. Panel 2 can thus fold back on itself in a specially designed kinematic operation in association with the folding of framework 1, as illustrated in FIGS. 3 and 4. A locking means, constituted by a U-channel 30 slidably mounted on panel portion 26 enables panel 2 to be rendered rigid in its unfolded position by engaging over the contiguous edges of the two panel portions 25 and 26, on either side of hinge 27.

Panel 2 of composite material closely mates with the form of main tube 3 of framework 1 without projecting externally and is thus perfectly protected against impact. Its upper face is perfectly plane, while its lower face has, at the front, a relatively large bulging portion 31 which is extended rearwards by two parallel longitudinal chevrons 32. This particular shape, which was studied at length, enables the stretcher, when it is thrown into the water, to turn automatically right side up and then to adopt a position inclined at approximately 45°, the upper end of the stretcher then being out of the water over a distance of approximately 50 cm. This ability to float at an angle of 45° is guaranteed when the stretcher is equipped with all its accessories required for winching by helicopter, that is to say a pendant and a length of cable of approximately 50 meters, the whole weighing approximately 3 kg.

According to another characteristic of the invention panel 2 of composite material is removably fixed to metallic framework 1. For this purpose, the front portion of the panel is provided with a recess engaging on bent portion 4 of main tube 3, while the rear portion is provided with two lugs 33 pierced with a hole in which engages a quarter turn pin 34 supported by the framework.

Thanks to this arrangement, it is possible, once the injured person has been recovered and brought back to shore, to unlock panel 2 quickly from framework 1 in order to transport the injured person on panel 2 to suitable X-ray facilities. For this purpose, the panel is fitted with straps 35 allowing the injured person to be secured directly thereto, independently of the framework, as well as with four flexible carrying handles 36. Preferably, the straps 35 will be provided with a quick fastening system the female portion of which will be fixed to the panel, thus enabling the rescuer to secure the injured person to the panel with one hand. In addition, the composite material of which the panel is made will advantageously be transparent to X-rays, which will enable the injured person to be X-rayed without having to move him needlessly.

To sum up, it will thus be appreciated that the floating stretcher according to the invention has many advantages over those currently in existence.

It is firstly foldable, thanks to its link type hinges 6 and 27, which considerably facilitates its storage, as well as its transport, possibly on a man's back. In its unfolded position ready for use, it is nonetheless very rigid, thanks to its locking means 9-10 and 30.

In addition, when it is thrown into the water, in whatever position, it turns right side up and, in less than a minute, it is in its floating position at an angle of approximately 45°, in which it subsequently remains permanently, whatever the state of the sea. This is due to the special shape of panel 2 of composite material and makes it possible, in the event of fractures or serious injury to the spinal column, to secure the injured person on the stretcher in the exact position in which he is floating with his life jacket. He is then hoisted up to the rescue helicopter in the same position and, from then on, there is no further need for the person to move until reaching the X-ray facilities of the hospital.

Once on shore, the extensible handles 22 and 23 are used, if necessary, and then panel 2 of composite material, attached to the injured person, is unlocked from framework 1 simply by retracting the two quarter turn pins 34 provided for this purpose. Framework 1 can then be fitted with a new panel for the purpose of another rescue operation, while the injured person is taken under optimum conditions to a hospital, using the carrying handles, still on the panel of composite material, on which he is firmly held by straps 35.

I claim:

1. A floating stretcher comprising an elongated metallic framework capable of being winched by a helicopter, and a panel of composite material supported by the framework that ensures the buoyancy of the stretcher, said panel and framework being hingedly connected at a median portion of the stretcher so that the stretcher can be folded back on itself lengthwise and said panel of composite material comprising two rigid portions hinged to one another by two panel hinges disposed on opposite sides thereof and a panel locking means for locking said panel hinges in a position to render said panel rigid in an unfolded position.

2. The floating stretcher of claim 1, wherein each panel hinge comprises a panel link pivotally mounted at each end thereof to each of the panel portions by a pin and the panel locking means comprises a U-channel slidably mounted over the panel link and engagable with contiguous edges of the two panel portions on either side of each hinge.

3. The floating stretcher of claim 1, wherein the metallic framework comprises a rigid main tube having a bent portion in the area of an injured person's head lying on the stretcher and two limb portions which extend substantially parallel in a direction toward the area of the feet of the person, each of the limb portions being hinged in the median portion of the stretcher by a framework hinge and framework locking means for locking each framework hinge in a position to render the framework rigid in an unfolded position.

4. The floating stretcher of claim 3, wherein each framework hinge comprises a framework link pivotally mounted at each end thereof to a limb portion by a pin and each framework locking means comprises a threaded sleeve slidably mounted on one of the limb portions for sliding movement over the framework link and engagable with a threaded member on the other limb portion when the framework is in an unfolded position.

5. The floating stretcher of claim 3, wherein the panel of composite material mates with the shape of the main tube of the framework and has a plane upper face, while its lower face has a bulging portion in the area of the head of the person that extends towards the area of the feet of the person in the shape of two parallel, longitudinally extending chevrons.

6. The floating stretcher of claim 3, wherein the panel of composite material is removably fixed to the metallic framework by a recess provided on a front portion thereof that engages the bent portion of the main tube, and by two pins on the limb portions that engage in lateral holes in the panel in the area of the feet.

7. The floating stretcher of claim 3, wherein the metallic framework has on a lower portion thereof a pair of secondary tubes of smaller diameter connected to the main tube by junction tubes and extending parallel to the limb portions so as to form two sled runners, the secondary tubes being interrupted in the median portion of the stretcher to permit the stretcher to be folded.

8. The floating stretcher of claim 3, including a hoop fixed to the framework in the area of the bent portion of the main tube and connected to it by junction tubes to protect the head of the injured person.

9. The floating stretcher of claim 3, including an extendable foot-rest mounted slidably in sheaths fixed to the ends of the two limb portions of the framework adjacent the area of the feet of the person and a foot rest locking means to lock said foot-rest in an extended position or in a retracted position.

10. The floating stretcher of claim 3, including extendable handles in the area of the feet and of the head of the person enabling the stretcher to be transported manually, the handles at the head area being slidably mounted in sheaths fixed to the main tube of the framework on either side of the bent portion, while the handles at the feet area are slidably mounted in the ends of the two parallel limb portions.

11. The floating stretcher of claim 1, wherein the panel of composite material has straps for securing the injured person to it and carrying handles.

* * * * *